United States Patent [19]

Kort

[11] 3,950,887

[45] Apr. 20, 1976

[54] BUBBLE-MAKING DEVICE

[76] Inventor: Fred Kort, c/o P.O. Box 18992, Dockweiler Station, Los Angeles, Calif. 90007

[22] Filed: Apr. 4, 1973

[21] Appl. No.: 347,552

[52] U.S. Cl. ..... 46/6
[51] Int. Cl.[2] ..... A63H 33/28
[58] Field of Search ..... 46/6, 7

[56] References Cited

UNITED STATES PATENTS

| | | | |
|---|---|---|---|
| 2,305,382 | 12/1942 | Hagopian | 46/6 |
| 3,064,387 | 11/1962 | Campbell | 46/7 |
| 3,109,255 | 11/1963 | Hein | 46/7 |
| 3,295,248 | 1/1967 | Knerr et al. | 46/6 |
| 3,579,898 | 5/1971 | Hein | 46/7 |

*Primary Examiner*—Louis G. Mancene
*Assistant Examiner*—Robert F. Cutting
*Attorney, Agent, or Firm*—Gardner and Anten

[57] ABSTRACT

A bubble-making device comprising an aperture edge means defining a bubble-making open aperture which is adapted to be dipped into a bubble-making liquid having suitable surface tension and capillary-action characteristics such as to cause a film of the liquid to be formed across the bubble-making open aperture whenever the aperture edge means is dipped thereinto and removed therefrom. The device is normally provided with effective handle means to facilitate handling the bubble-making device and includes a supplementary area-increasing, liquid-pickup means comprising an effectively perforate structure carried by the aperture edge means and, in a preferred form, extending inwardly thereof and adapted to increase the amount of the bubble-making liquid picked up when dipped into the bubble-making liquid and subsenquently available for bubble-making purposes when air is forced through the bubble-making aperture and against a film of the bubble-making liquid normally extending thereacross.

7 Claims, 18 Drawing Figures

BUBBLE-MAKING DEVICE

BRIEF SUMMARY OF THE INVENTION

Generally speaking, the present invention relates to a bubble-making device of the type comprising means forming an open bubble-making aperture which is usually provided with an operating handle and is adapted to be dipped into a special bubble-making liquid having surface tension and capillary action characteristics such as to cause the formation of a liquid film across the open bubble-making aperture when the device is dipped into the bubble-making liquid and such as to form one or more (usually a plurality of) bubbles when air is forced through the bubble-making aperture against the surface of such a liquid film. The device of the present invention is of the general type described above and is further provided with supplementary area-increasing liquid-pickup means adapted to greatly increase the amount of such bubble-making liquid which will be picked up by the device when it is dipped into a quantity of such bubble-making liquid and to do so in a manner such that the increased quantity of bubble-making liquid will be effectively contiguous with respect to and comprise a part of the amount of bubble-making liquid normally picked up by the aperture edge means around the bubble-making aperture by itself. This means that when air (or other gas) is forced through the bubble-making open aperture against the surface of a film of the bubble-making liquid extending across the aperture, there is a greater effective reservoir of the bubble-making liquid to be drawn upon, and consequently as each bubble is formed and breaks away and a subsequent bubble begins to form during the forcing of air through the bubble-making aperture, the additional amount of bubble-making liquid will be effectively drawn as a consequence of molecular attraction (surface tension and/or capillary action effects) toward the bubble-making aperture so as to continue to supply same with the bubble-making liquid so that, as a consequence thereof, a much greater number of bubbles can be so formed before it is necessary to again dip the bubble-making device in the bubble-making liquid. In one preferred form of the invention, the supplementary, area-increasing, liquid-pickup means comprises an effectively perforate structure carried by the aperture edge means and extending inwardly thereof.

In a particular preferred form, said perforate structure comprises a plurality of inwardly directed fingers spacedly mounted along the inner side of the aperture edge means in a manner providing intermittent solid and apertured regions at the outer periphery of the bubble-making aperture and, in most forms thereof, effectively extending into the bubble-making aperture to some extent. This means that several times as much of the bubble-making liquid will be picked up by the combination of the aperture edge means and the plurality of inwardly directed fingers as would be picked up by the aperture edge means alone and most of this picked-up bubble-making liquid will be available for bubble-making purposes and will be effectively fed to the bubble-making open aperture as needed — the need or demand therefor being provided by the formation of bubbles from liquid film extending across the aperture and the blowing away of such bubbles.

In one preferred form, the bubble-making device includes handles means, which extends outwardly from the exterior periphery of the aperture edge means to facilitate the handling of the entire bubble-making device and, in a preferred form thereof, it may be upwardly offset from a plane thereof carrying the aperture edge means whereby to facilitate the temporary dipping (or placing) of the aperture edge means and the supplementary liquid-pickup means downwardly into a tray (or other container) holding a quantity of the bubble-making liquid — this being one exemplary, but non-specifically-limiting, means for effectively applying a coating of the bubble-making liquid to the aperture edge means and the supplementary liquid-pickup means prior to forcing air through the bubble-making aperture and against a film of said bubble-making liquid for the purpose of producing multiple airborne moving bubbles.

In a preferred form, the aperture edge means may comprise a substantially circular ring (usually planar, although not specifically limited in all forms thereof) having said supplementary liquid-pickup means carried along the inner side of the ring. Of course, more than one such ring may be included in the bubble-making device as a part of the aperture edge means in certain forms of the invention.

In a preferred version, the entire device is made of integral formed construction, preferably of a substantially liquid-impervious material which will be relatively unaffected by the bubble-making liquid. This may comprise a moldable thermoplastic or thermosetting material, if desired, although not specifically so limited in all forms of the invention.

OBJECTS OF THE INVENTION

With the above points in mind, it is an object of the present invention to provide a novel bubble-making device of the character referred to herein, generically and/or specifically, and which may include any or all of the features referred to herein, either individually or in combination, and which is of extremely simple, inexpensive, easy-to-manufacture, easy-to-use construction, suitable for the purposes outlined herein or for any substantially equivalent or similar purposes.

Further objects are implicit in the detailed description which follows hereinafter (which is to be considered as exemplary of, but not specifically limiting, the present invention), and said objects will be apparent to persons skilled in the art after a careful study of the detailed description which follows.

For the purpose of clarifying the nature of the present invention, several exemplary embodiments of the invention are illustrated in the hereinbelow-described figures of the accompanying two sheets of drawings and are described in detail hereinafter.

BRIEF DESCRIPTION OF THE DRAWINGS

FIG. 3 is drawn to a larger scale than FIG. 1.

Figure 6:
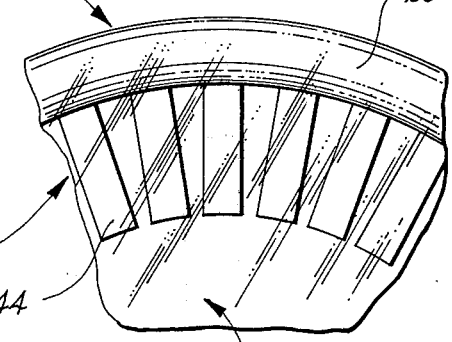
FIG. 6 is an enlarged, fragmentary plan view of that portion of the bubble-making device enclosed by the ellipse and indicated by the arrow 6 of FIG. 3 and with the underlying tray containing bubble-making liquid removed entirely from this view.

Each of FIGS. 7 through 12 is an enlarged fragmentary view similar to FIG. 6 but illustrating in each case a different, slight modification of the supplementary liquid-pickup means.

Figure 3:
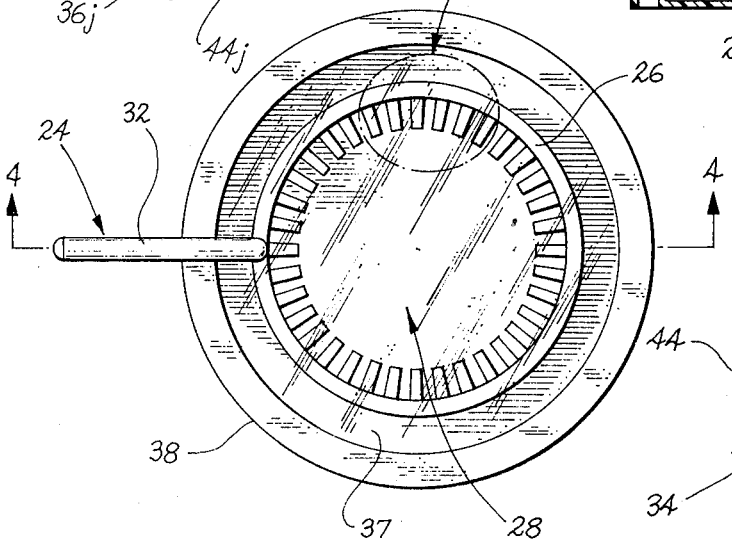
FIG. 3 is a top plan view of the device as it would appear to the operator of the device when moved from the use orientation shown in FIG. 1 downwardly into the tray containing the bubble-making liquid so as to replenish the supply of bubble-making liquid on the device before returning it to the use position shown in FIG. 1 for blowing additional bubbles. However.
Figure 13:
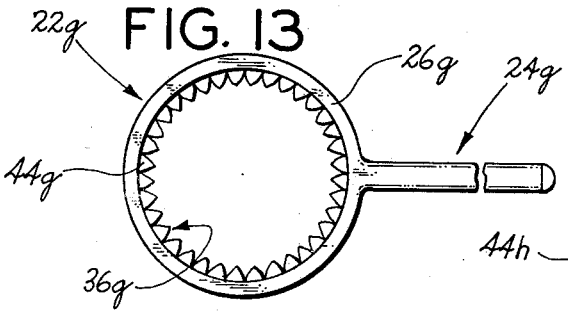

FIG. 13 is a reduced-size, top plan view illustrating a modified form of the bubble-making device in an orientation similar to that shown in FIG. 3 of the first form of the invention, but with the tray containing bubble-making liquid removed entirely and also with the handle being shown positionally reversed and not being vertically off-set and further illustrating another modified form of the supplementary liquid-pickup means.

Figure 14:
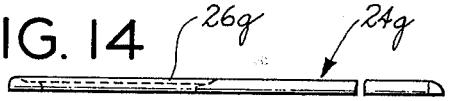

FIG. 14 is a side elevational view of FIG. 13.

Figure 15:
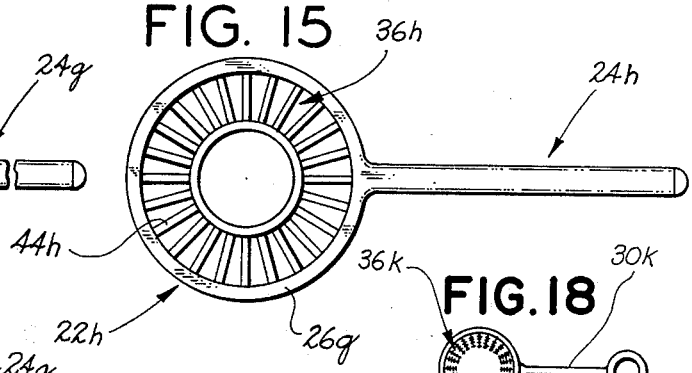

FIG. 15 is a view similar to FIG. 13, but illustrates a further slight modification thereof.

Figure 16:
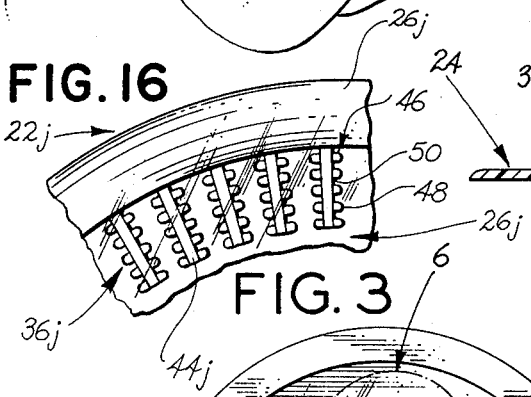
Figure 4:
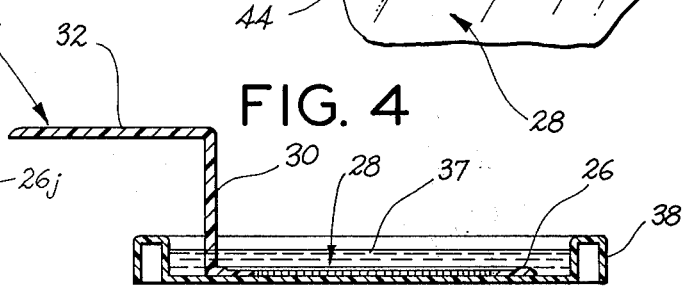
FIG. 4 is a cross-sectional view taken substantially along the plane and in the direction indicated by the arrows 4—4 of FIG. 3.

FIG. 16 is a fragmentary top plan view similar in aspect to FIG. 6 but illustrates another very important variation of the supplementary liquid-pickup means.

Figure 17:
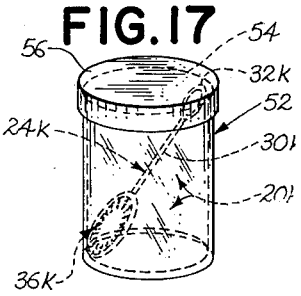

FIG. 17 is a view showing a smaller form of the bubble-making device in an initially enclosed position within a bottle of the bubble-making liquid, thus providing a composite package having everything needed for bubble-making purposes in one container.

Figure 18:
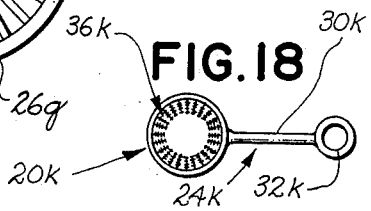

FIG. 18 is a view of the bubble-making device of FIG. 17 shown alone after removal from within the jar of bubble-making liquid for the purpose of more clearly showing the construction of the bubble-making device per se.

DESCRIPTION OF THE PREFERRED EMBODIMENTS

Generally speaking, the bubble-making device of the present invention comprises aperture edge means forming or defining a bubble-making open aperture, with the device usually being effectively provided with a distinct handle means, or some portion of the device which effectively functions as a handle means and may be said to effectively comprise a handle means, for use in facilitating the grasping and operation of the device.

In the exemplary first form of the invention illustrated in FIGS. 1–6 inclusive, the complete bubble-making device is generally designated by the reference numeral 20, the aperture edge means is shown as being of exemplary, but not specifically limiting, circular shape and is generally designated by the reference numeral 22, and the handle means is generally designated by the reference numeral 24. It will be noted that the circular aperture edge means 22 comprises a substantially circular planar ring 26 which defines the bubble-making open aperture indicated at 28 and which includes a substantial cross-sectional open area lying across and within the ring 26.

It should also be noted that, in the exemplary first form of the invention illustrated, the handle means 24 is of an offset type including an inner portion 30 connected to one edge of the ring 26 and extending therefrom in a direction parallel to the axis of the ring 26 and provided with and connected to a second outer handle part 32 which is substantially perpendicular to the first handle part 30, and, thus, lies substantially in a plane spaced from and parallel to the plane in which the ring 26 and the bubble-making opening 28 lie.

Figure 5:
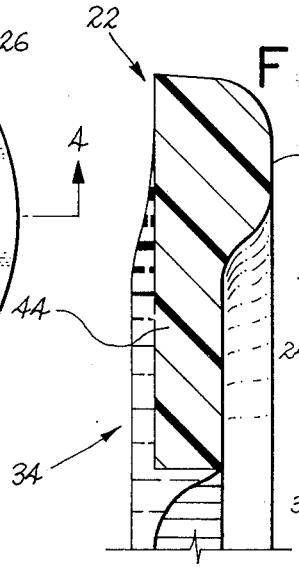
FIG. 5 is a greatly enlarged, fragmentary, sectional view taken substantially along the plane and in the direction indicated by the arrows 5—5 of FIG. 1.

The aperture edge means 22, comprising the circular ring 26 in the example illustrated, is provided with supplementary area-increasing liquid-pickup means in liquid-feeding relationship relative to the ring 26 and primarily to the bubble-making opening 28 and to any film, such as that shown at 34, of bubble-making liquid adapted to extend across the bubble-making opening 28, as is best shown in FIG. 5. In the exemplary first form of the invention illustrated, said supplementary area-increasing liquid-pickup means is generally designated by the reference numeral 36 and takes one representative form which will be described in greater detail hereinafter.

Figure 1:
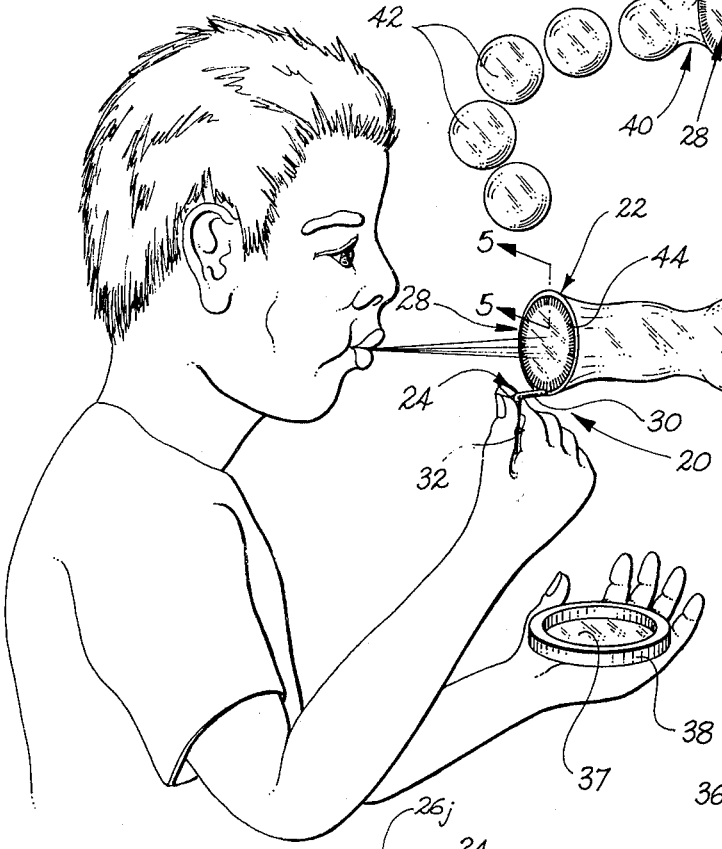
FIG. 1 is a reduced-size, fragmentary, three-dimensional view showing one exemplary embodiment of the invention in actual bubble-making use of one particular type wherein air is orally blown through the aperture edge means and against a film of the bubble-making liquid extending thereacross.

The bubble-making liquid referred to above is usually a special liquid including one or more constituents which impart surface tension and capillary action characteristics to the complete bubble-making liquid mixture such as to normally cause a coating of the bubble-making liquid to be applied to the ring 26 and to extend across the bubble-making opening 28 in the form of a thin film, such as is shown at 34 in FIG. 5, whenever said ring 26 is dipped into a quantity of bubble-making liquid, such as is shown at 37 in the liquid-containing flat tray 38 of FIGS. 1 and 3. In other words, the handle 24 is manually grasped and the ring 26 is dipped into the liquid 37 within the tray 38 and is then removed and it will be found that a substantial coating of the liquid will be retained on the surface of the ring 26 and said liquid will have formed a central film 34 extending across the bubble-making opening 28. This is the condition of the complete bubble-making device as shown in FIG. 1, and as shown in FIG. 2, adapted to be followed in each case by the next succeeding action for the purpose of forcing air through the bubble-making opening 28 and against the film 34 so as it will be stretched or drawn out in the general manner indicated at 40 in FIG. 1 and will then break up, as a consequence of the surface tension and capillary action characteristics thereof, into a plurality of spherical airborne moving bubbles, such as the exemplary one shown at 42 in FIG. 1 or the plurality of such bubbles shown at 42 in FIG. 2.

An extremely important feature of the present invention is the hereinbefore-mentioned supplementary area-increasing liquid-pickup means, indicated generally at 36, which, in the exemplary first form of the invention, comprises a perforate structure carried by the aperture edge means 22 and takes the form of a plurality of inwardly, substantially radially directed fingers 44 spacedly mounted along the inner surface or side of the ring 26 of the aperture edge means 22 in a manner providing intermittent solid and apertured regions co-extensive with the outer peripheral portion of the bubble-making open aperture 28, as is best shown in FIGS. 3, 5, and 6.

It will be understood that, when the entire ring 26 and the plurality of inwardly directed fingers or teeth 44 are dipped into the tray 38 containing the bubble-making liquid 37, a substantially greater quantity of said bubble-making liquid will be coated upon and effectively picked up by the configuration of the ring and plurality of fingers 44 than would be true of prior art bubble-makers, and yet this will in no way interfere with the conventional formation of a thin film, such as that shown at 34, across the bubble-making opening 28.

Figure 2:
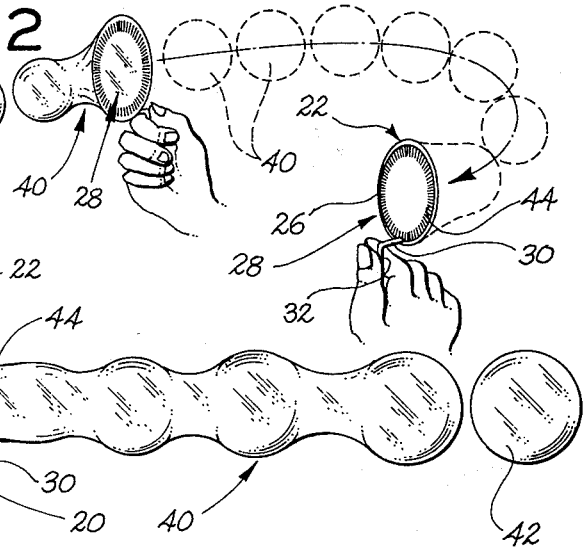
FIG. 2 is a fragmentary view illustrating two different positions of the bubble-making device when used in a different bubble-making mode of operation wherein the device is rapidly moved through ambient atmosphere to force air against the film of bubble-making liquid carried by the device whereby to form one or more bubbles.

Thus, when bubbles are formed in either of the two manners shown in FIGS. 1 and 2 by effectively forcing air through the bubble-making aperture 28 and against the surface of the film 34, the additional or supplementary liquid carried by the inwardly directed fingers 44 will be fed to the film 34 as it is blown out into extended relationship, such as is shown in FIG. 1 at 40, for example, and is caused to break up into a plurality of bubbles, such as shown at 42 in FIG. 1 and also 42 in FIG. 2. This liquid-feeding action will continue for some period of time and, thus, causes a much greater number of bubbles 42 to be produced before it is again necessary to dip the entire ring 26 and the supplementary liquid-pickup means 36 into the tray 38 containing the bubble-making liquid 37. In other words, a child or other person using the device in the manner shown in FIG. 1, will find that the bubble-making capacity of conventional prior art bubble-making rings, loops, and the like, is greatly increased by the novel supplementary liquid-pickup means of the present invention.

The bubble-making procedure shown in FIG. 1 merely comprises blowing directly onto the film 34 so as to force it into the elongated configuration shown at 40 in FIG. 1 which will be followed by the breaking up of same into multiple bubbles such as shown at 42 in a manner previously described. However, the device is not limited to having the bubbles formed by a blowing action, but instead may be swung through the air in the manner shown in FIG. 2 which will also effectively cause the movement of air relative to the film 34 and cause it to be drawn out into an elongated form, such as is shown at 40 in FIG. 2, which breaks up into a plurality of bubbles, such as shown at 42 in FIG. 2.

The two different modes of operation illustrated are not necessarily to be construed as limiting and are merely exemplary of the two particular ways of effectively moving air relative to the film of bubble-making liquid so as to stretch out and distend same and cause the breaking off of portions thereof into multiple airborne moving bubbles such as shown at 42.

Figure 7:
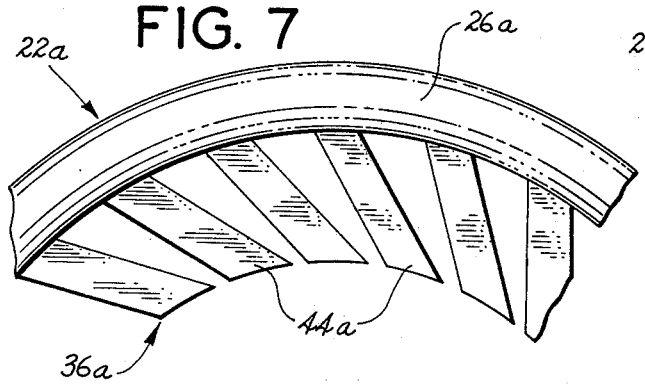
Figure 10:
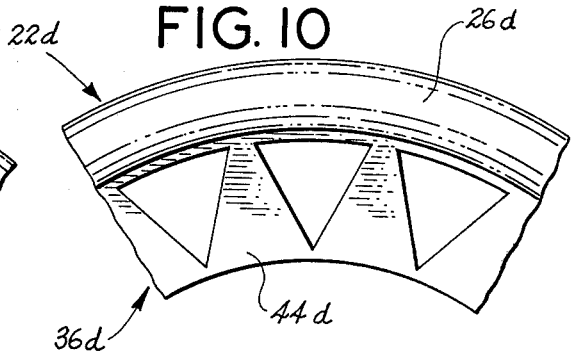
Figure 8:
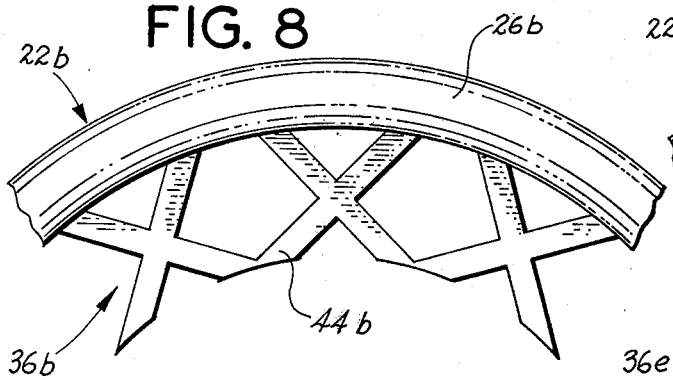
Figure 11:
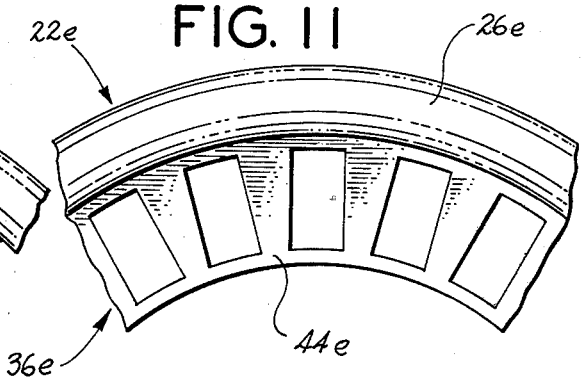
Figure 9:
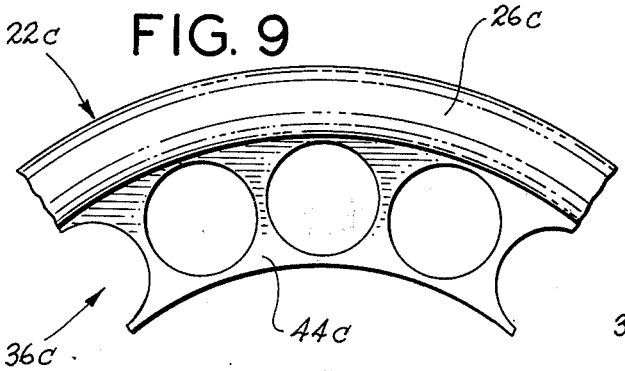
Figure 12:
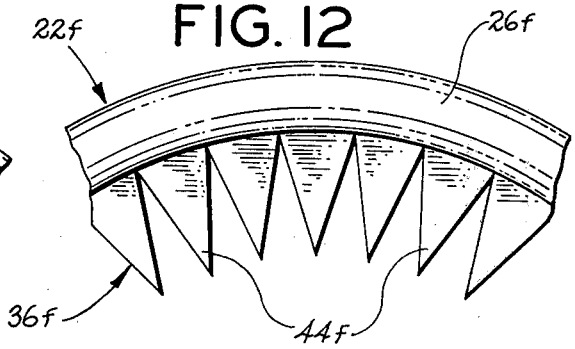

It should be noted that the supplementary area-increasing liquid-pickup means is not limited to the particular exemplary form thereof shown at 36 in the first version of the invention but may include a number of modified forms thereof as illustrated in sequence in the plurality of similar views comprising FIGS. 7–12, inclusive, wherein similar parts in each succeeding figure are designated by reference numerals similar to those in the first form of the invention followed by the letters "*a*" in the case of FIG. 7, "*b*" in the case of FIG. 8, "*c*" in the case of FIG. 9, "*d*" in the case of FIG. 10, "*e*" in the case of FIG. 11, and "*f*" in the case of FIG. 12. Since all other portions of said modified forms of the invention are substantially identical to the previously fully described first form of the invention, no further individual and detailed description of each different one of said modifications is thought necessary or desirable in view of its obvious redundancy.

FIG. 13 illustrates a further slight modification of the invention and, therefore, parts which are generally similar either structurally or functionally, to corresponding parts of the first form of the invention are designated by similar reference numerals followed by the "*g*," however. It will be noted that the entire ring **26*g* of the aperture edge means 22*g* is similar to the first form of the invention, but that the supplementary liquid-pickup means, indicated generally at 36*g*, is slightly differently shaped from the first form of the invention and further that the handle means 24*g* is also modified in that it is not upwardly offset from the ring 26*g* but instead lies substantially in the same plane as is best shown in FIG. 14**.

FIG. 15 is a further slight modification of the invention and, therefore, parts which are structurally or functionally generally similar to the first form of the invention are designated by similar reference numerals followed by the letter "*h*." In this modification it will be noted that the handle **24*h* is substantially similar to the handle 24*g* of the FIG. 13 and FIG. 14 modification and that the supplementary liquid-pickup means 36*h*** is of a different configuration and structure from any of the previously illustrated forms thereof. No further description is thought necessary in view of its obvious redundancy.

FIG. 16 is a view of aspect similar to FIG. 6 showing a further modification of the supplementary, area-increasing liquid-pickup means which, in this case, is indicated generally by the reference numeral **36*j***. Indeed all portions of this variation corresponding to previously described forms are designated by similar reference numerals followed by the letter "*j*," however. It will be noted that in this modification the perforate structure carried by the aperture edge means **22*j* takes the same form as that shown in FIG. 6 wherein it comprises a plurality of inwardly directed fingers 44*j* spacedly carried by the inside of the ring 26*j* of the aperture edge means 22*j* and, thus, to this point is substantially identical to the showing of FIG. 6. However, it should be clearly understood that in the FIG. 16 variation, each of the fingers 44*j* is provided with a plurality of laterally directed serration means, such as indicated by the reference numeral 46, each of which, in the specific example illustrated, comprises similarly laterally directed teeth 48 defining along the length of each finger 44*j* a plurality of sets of additional small-dimension spaces 50 adapted to greatly increase the amount of liquid which the complete area-increasing liquid-pickup means, indicated generally at 36*j*, can pick up and hold until fed toward the bubble-making open aperture 28*j*** as needed for bubble-making purposes.

It should be clearly understood that this important concept is not limited to only inwardly directed, or to only radially directed, fingers but is broad enough to include the concept of fingers which also extend outwardly or wherein the complete ring means is effectively grooved or serrated and to non-radial arrangements. The important point is that the surface area of the liquid-pickup means **36*j* or perforate structure provided by the fingers 44*j* (and the serration means 46**) is greatly increased.

FIGS. 17 and 18 illustrate a further slight modification of the bubble-making device or wand in a smaller, more simply constructed form such as to be suitable to be supplied initially positioned in a quantity of the bubble-making liquid in a bubble-making liquid container or jar so that when the lid of the jar is removed, the bubble-making device will be immediately available for bubble-making usage. In the example illustrated, a bubble-making container or jar is designated by the reference numeral 52 and has a top opening 54 normally closed by a removable cover or cap 56 and is adapted to be initially supplied substantially full of the bubble-making liquid. Also positioned within the hollow interior of the jar or container 52 is a small version of the bubble-making device which is generally designated by the reference numeral 20*k*. Indeed, all portions of the device structurally or functionally equivalent to previously described forms of the invention are designated by similar reference numerals, followed by the letter "*k*," however. The small bubble-making device 20*k* has a straight rather than an offset handle means 24*k* including a ring-shaped, manually graspable portion 32*k* and an intermediate connecting portion 30*k*. However, the exact configuration of the complete handle means may be modified substantially. For example, the ring-shaped manually graspable portion 32*k* may comprise another supplementary area-increasing liquid-pickup means identical to the one shown at the opposite end thereof and indicated by the reference numeral 36*k* in FIG. 18, which, of course, is identical to the one shown at 36*j* in FIG. 16. In other words, the small form of the invention shown in FIGS. 17 and 18 may be double-ended with each end being identical and comprising a bubble-blowing structure having the novel improved form of the area-increasing liquid-pickup means best shown previously at 36*j* in FIG. 16. Other convenient handle configurations or convenient double-ended bubble-blowing structures may be employed in lieu of the specific representative arrangement illustrated in FIGS. 17 and 18. The complete aperture edge means 36*j* may be of the same type as that illustrated in the FIG. 16 form of the invention, or the FIG. 16A form of the invention, in a preferred version, although it may assume any of the configurations of the various different aperture edge means and area-increasing liquid-pickup means illustrated in any of the figures of the drawings or described or referred to in any of the description hereinbefore set forth.

In a preferred form of the invention the entire device may be made of integral formed, molded or stamped construction although one exemplary preferred form is of molded construction wherein the entire device is made of a plastic material, which usually will be a thermoplastic material although not specifically so limited in all forms thereof. Also the plastic material is preferably of a non-corrodible nature insofar as the bubble-making liquid 37 is concerned so as to be unaffected thereby.

It should be noted that the invention is not limited to circularly shaped aperture edge means nor to the use of a single such aperture edge means defining a single bubble-making open aperture. Multiples thereof in any desired amount may be employed within the broad scope of the present invention.

It should also be noted that while the bubble-making open aperture, such as that shown at 28, has been both illustrated and described as being substantially planar, it is not specifically limited to such a planar construction, but may define a curved surface of any desired contour provided that there is effective normal cross-sectional area normal to the path of forced air movement which will cause the bubble formation action to occur, and all such modifications are intended to be included and comprehended within the broad scope of the present invention.

It should be understood that the figures and the specific description thereof set forth in this application are for the purpose of illustrating the present invention and are not to be construed as limiting the present invention to the precise and detailed specific structure shown in the figures and specifically described hereinbefore. Rather, the real invention is intended to include substantially equivalent constructions embodying the basic teachings and inventive concept of the present invention.

What is claimed is:

1. A bubble making device comprising a. an annular film supporting ring member defining an open aperture;

b. a plurality of primary projections extending inwardly from the ring member in the plane of the open aperture, at least one of said primary projections having at least one secondary projection extending from a side of said primary projections in the plane of the open aperture.

2. The bubble blowing device of claim 1 in which said primary projections extend from the ring member substantially radially into said open aperture.

3. The bubble blowing device of claim 2 in which said secondary projections extend from said primary projections in a direction substantially perpendicular to said primary projections.

4. The bubble blowing device of claim 2 in which said secondary projections extending from the primary projections form a circular member within said open aperture, said circular member having intermittent segments removed.

5. The bubble blowing device of claim 4 in which said secondary projections form more than one circular member having intermittent segments removed.

6. The bubble blowing device of claim 5 in which said primary projections are symmetrically spaced around said ring member.

7. The bubble blowing device of claim 6 in which a handle means extends from said supporting ring.

* * * * *